US011180316B1

(12) United States Patent
Harris

(10) Patent No.: US 11,180,316 B1
(45) Date of Patent: Nov. 23, 2021

(54) COLLAPSIBLE WASTE CONTAINER

(71) Applicant: Andre Harris, Bowie, MD (US)

(72) Inventor: Andre Harris, Bowie, MD (US)

( * ) Notice: Subject to any disclaimer, the term of this patent is extended or adjusted under 35 U.S.C. 154(b) by 702 days.

(21) Appl. No.: 16/048,256

(22) Filed: Jul. 28, 2018

(51) Int. Cl.
*B65F 1/14* (2006.01)
*B65F 1/00* (2006.01)

(52) U.S. Cl.
CPC ..... *B65F 1/1426* (2013.01); *B65F 1/00* (2013.01)

(58) Field of Classification Search
CPC .. B65D 88/52; B65D 88/526; B65D 11/1866; B65D 9/18; B65D 9/12; B65D 7/30; B65D 7/24; B65D 7/12; B65D 2501/24987; B65D 19/42; B65D 2519/00781; B65F 1/1426; B65F 1/00
USPC ..... 220/4.01–8
See application file for complete search history.

(56) References Cited

U.S. PATENT DOCUMENTS 880,082 A * 2/1908 Kendrick ..... B65D 1/04 215/6
2,326,414 A * 8/1943 Thompson ..... B65D 7/00 220/4.27
2,740,981 A * 4/1956 Famolare ..... A47L 5/365 15/246.4
4,167,271 A * 9/1979 Jorgensen ..... B62B 3/104 16/30
4,598,832 A * 7/1986 Alonso ..... A47J 41/0083 215/10
5,294,137 A * 3/1994 Barber ..... B62B 3/10 220/4.04
5,295,606 A * 3/1994 Karwoski ..... B65F 1/06 220/4.01
5,356,031 A * 10/1994 Jondelius ..... A47B 87/02 206/501
5,422,129 A * 6/1995 Draddy ..... B65D 21/08 215/10
5,862,932 A * 1/1999 Walsh ..... B65D 21/086 220/8
6,223,927 B1 * 5/2001 Rand ..... B65F 1/14 220/495.06
8,684,208 B2 * 4/2014 Hotell ..... B65D 21/0209 220/4.26
2011/0248037 A1 * 10/2011 Fung ..... B65D 81/3869 220/592.2
2012/0205371 A1 * 8/2012 Lee ..... B65D 47/286 220/8

(Continued)

*Primary Examiner* — Kareen K Thomas
(74) *Attorney, Agent, or Firm* — Gulf Coast Intellectual Property Group

(57) ABSTRACT

A waste container that is configured to be expandable and collapsible so as to provide at least two alternate interior volume capacities. The waste container includes a body having a base member wherein the base member is configured with opposing wheels and a recess for an axle. The body further includes two first ring members and a second ring member wherein the second ring member is intermediate the two first ring members. The second ring member has a diameter that is slightly larger than the first ring members. The two first ring members and a second ring member are configured to be slidably and frictionally engaged so as to provide a first and second position of the waste container. The body further includes a top assembly that is operably coupled to the first ring member above the second ring member. A lid is releasably secure to the top assembly.

9 Claims, 4 Drawing Sheets

(56) References Cited

U.S. PATENT DOCUMENTS

2013/0264340 A1* 10/2013 Zens ..... B65B 1/02
220/8

* cited by examiner

COLLAPSIBLE WASTE CONTAINER

FIELD OF THE INVENTION

The present invention relates generally to containers, more specifically but not by way of limitation a collapsible waste container wherein the waste container of the present invention is vertically adjustable so as to provide at least a first position and a second position of the waste container of the present invention.

BACKGROUND

Containers such as but not limited to waste containers are commonly utilized in both commercial and residential environments. Waste containers are typically available in various sizes and types depending upon the desired application. Some common types of waste containers are conventional kitchen trash cans that are smaller in size and often have a hingedly secured lid. Additional types of waste containers include larger waste containers that are utilized for applications such as but not limited to outdoor waste or collection of waste to then be collected by local waste management on a routine basis.

One problem with convention waste containers is their fixed size. If a user purchases an outdoor style trash container, these containers are typically too large to be utilized in alternate environments such as but not limited to a kitchen or other indoor space. Additionally, the aforementioned larger waste containers require sufficient space for storage. If a user must store an outdoor waste container in a garage of similar location, the large size of a conventional outdoor waste container can be inconvenient for storage. Furthermore, conventional waste containers are not adjustable in size which creates a large consumption of space when a person is moving.

Accordingly, there is a need for a waste container that is configured to be vertically adjustable so as to provide alternate interior volume capacities and further provide a waste container that provides a reduced overall size when not in use.

SUMMARY OF THE INVENTION

It is the object of the present invention to provide a waste container that is configured to provide vertical expansion and contraction of the body of the waste container.

Another object of the present invention is to provide an expandable and collapsible waste container so as to provide alternate interior volume capacities wherein the body of the waste container of the present invention includes a base assembly.

A further object of the present invention is to provide a waste container that is configured to provide vertical expansion and contraction of the body wherein the body further includes a first ring member that is operably coupled to the base assembly.

Still another object of the present invention is to provide an expandable and collapsible waste container so as to provide alternate interior volume capacities wherein the body of the present invention further includes a second ring member, wherein the second ring member is operably coupled to the first ring member.

An additional object of the present invention is to provide a waste container that is configured to provide vertical expansion and contraction of the body wherein the body includes at least two first ring members and one second ring member.

Yet a further object of the present invention is to provide an expandable and collapsible waste container so as to provide alternate interior volume capacities wherein the first ring member and second ring member are slidably coupled.

Another object of the present invention is to provide a waste container that is configured to provide vertical expansion and contraction of the body that further includes a top assembly wherein the top assembly is operably coupled to the uppermost first ring member.

Still an additional object of the present invention is to provide an expandable and collapsible waste container so as to provide alternate interior volume capacities wherein the top assembly further includes a lid configured to be secured thereto.

A further object of the present invention is to provide a waste container that is configured to provide vertical expansion and contraction of the body wherein the body is manufactured from a durable suitable material such as but not limited to plastic.

Still another object of the present invention is to provide an expandable and collapsible waste container so as to provide alternate interior volume capacities wherein the base assembly further includes wheels to facilitate transport of the present invention.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
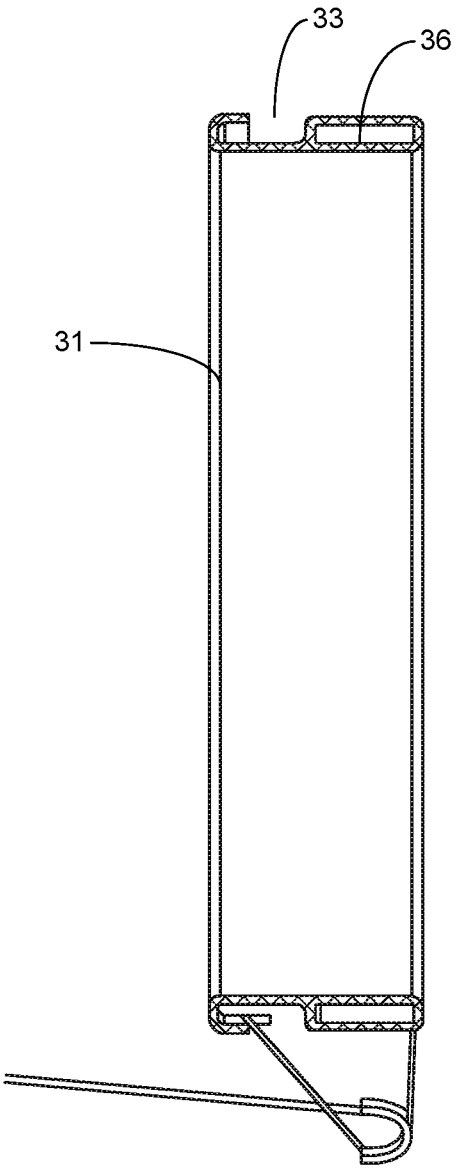
FIG. 1 is cross sectional view of the top assembly of the present invention.

Referring now to the drawings submitted herewith, wherein various elements depicted therein are not necessarily drawn to scale and wherein through the views and figures like elements are referenced with identical reference numerals, there is illustrated a collapsible waste container 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof, the collapsible waste container 100 includes a body 5 that is manufactured from a suitable durable material such as but not limited to plastic. The body 5 is manufactured from a plurality of ring members 10 that are further discussed herein. The ring members 10 are intermediate the base assembly 15 and top assembly 20 and are configured to be slidably coupled so as to provide a first vertical position and a second vertical position. The base assembly 20 includes wall 21 and bottom 22 wherein the wall 21 and bottom 22 are integrally formed to create an interior volume (not illustrated herein). The base assembly 20 includes opposing wheel cavities 23 that are arcuate in formed and configured to provide a recess for the wheels 24. Intermediate the wheel cavities 23 are a plurality of axle support members 25. The axle support members 25 are positioned adjacent to each other having voids 26 intermediate each axle support member 25. The axle support members 25 include aperture 27 wherein the aperture 27 is operable to receive axle 28 therethrough so as to operably couple the wheels 24. The axle support members 25 are formed in recess 29 wherein the recess 29 and wheel cavities 23 function to reduce the distance the wheels 24 extend outward from the circumferential edge 19 of the base assembly 20. The aforementioned promotes more efficient storage as the overall footprint of the collapsible waste container 100 is reduced.

Figure 2:
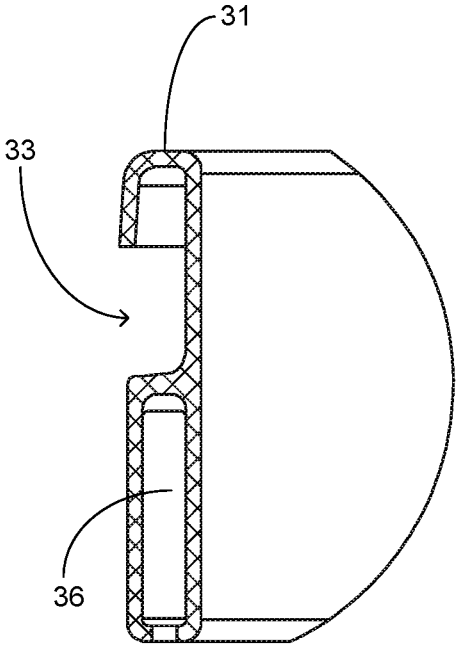
FIG. 2 is detailed view of a portion of the top assembly.

Opposite the base assembly 20 is the top assembly 30. The top assembly 30 includes an annular shaped wall 31 having a handle 32 contiguously formed therewith and extending outward therefrom. It is contemplated within the scope of the present invention that the collapsible waste container 100 could have more than one handle 32 formed with the wall 31 of the top assembly 30. The top assembly 30 includes a circumferential groove 33 that completely encircles the wall 31 and is formed therein utilizing suitable techniques. The circumferential groove 33 is configured to releasably secure the lid 40, in particular the lower edge 41 thereof. The lid 40 further includes opposing handgrips 42,43 that provide an element that offers a technique to remove the lid 40 from the circumferential groove 33. While a circumferential groove 33 has been illustrated and discussed herein for providing a technique to releasably secure the lid 40, it is contemplated within the scope of the present invention that the lid 40 could be releasably secured to the top assembly 30 utilizing alternate elements and/or techniques. FIG. 2 illustrates a cross-sectional of the wall 31 of the top assembly 30. The wall 31 includes a lower cavity 36 that is formed within the entire wall 31. The lower cavity 36 is operable to provide a reduced weight for the top assembly 30 and further facilitate the reduction of materials required to manufacture the top assembly 30. While a lower cavity 36 is formed in the wall 31 in the preferred embodiment thereof, it is contemplated within the scope of the present invention that the wall 31 could be formed without a lower cavity 36.

Figure 3:
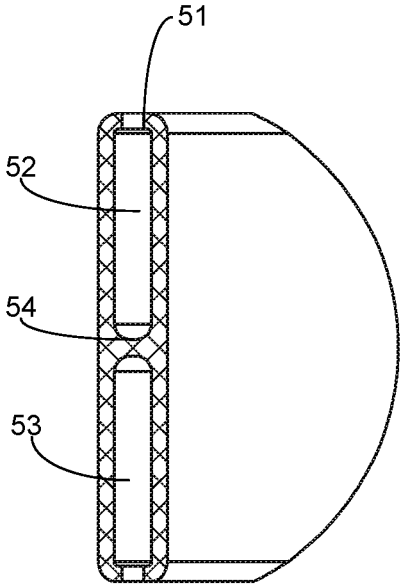
FIG. 3 is a cross section view of a second ring member of the present invention.
Figure 4:
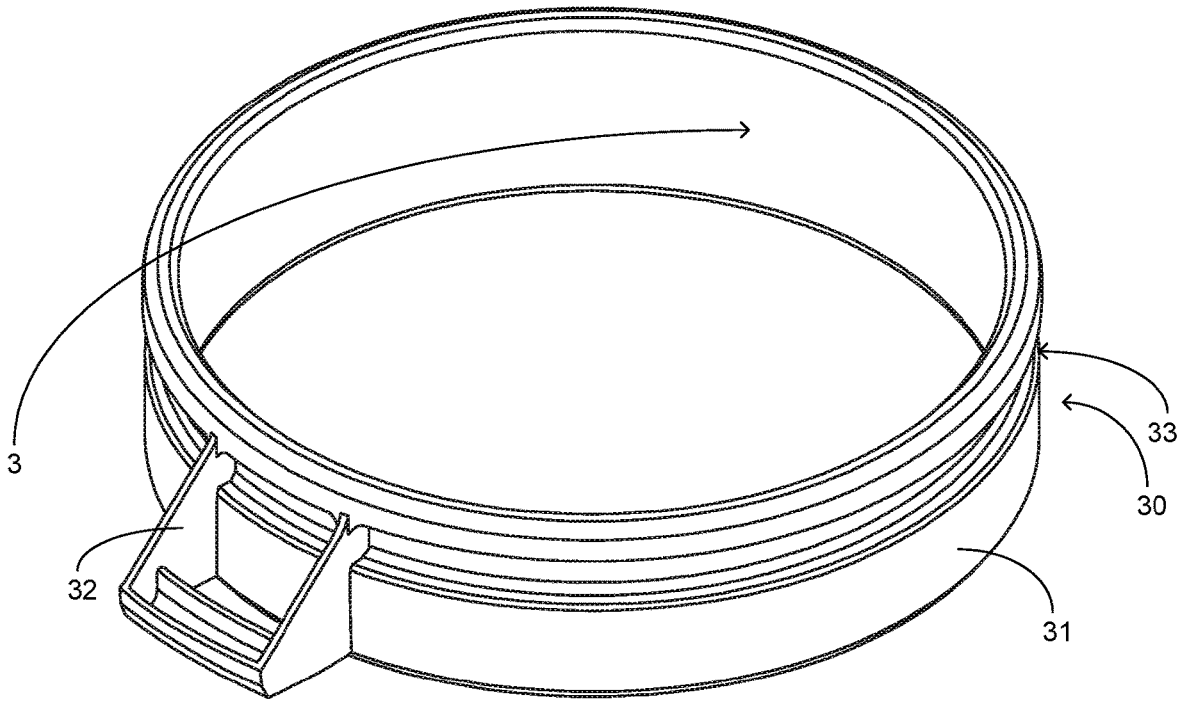
FIG. 4 is a perspective view of the top assembly of the present invention.
Figure 5:
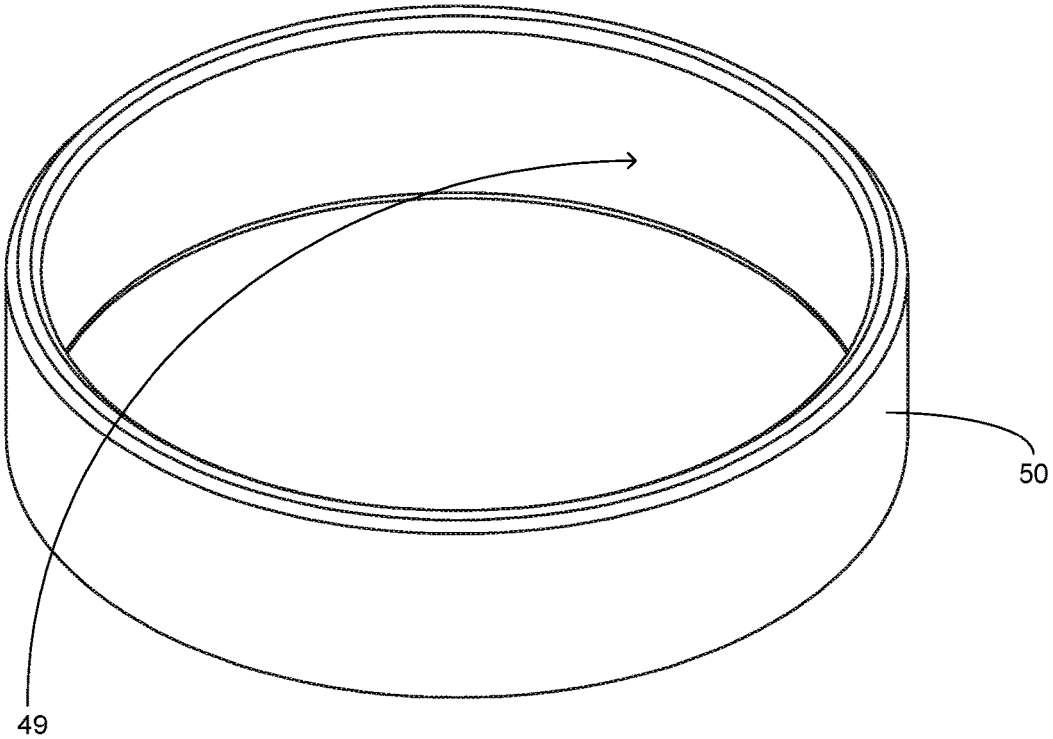
FIG. 5 is a perspective view of a second ring member of the present invention.

The body 5 further includes a second ring member 50 that is manufactured from a suitable durable material such as but not limited to plastic. The second ring member 50 includes wall 51 and is annular in shape. As shown in particular in FIG. 3, the second ring member 50 includes an upper cavity 52 and lower cavity 53 having a partition 54 therebetween. The upper cavity 52 and lower cavity 53 combine to reduce the weight of the second ring member 50 while the partition 54 intermediate the upper cavity 52 and lower cavity 53 provides the structural rigidity to maintain the integrity of the wall 51 despite the presence of the upper cavity 52 and lower cavity 53. While a upper cavity 52 and lower cavity 53 are illustrated herein it is contemplated within the scope of the present invention that the wall 51 could be formed with only one cavity or no cavity. The second ring member 50 is located approximately in the midpoint of body 5 and is formed having a diameter that is greater than that of the first ring members 60. The larger diameter of the second ring member 50 allows for the slidably coupling of the second ring member 50 to the first ring members 60 as will be further discussed herein. While the body 5 is illustrated herein as having only one second ring member 50, it is contemplated within the scope of the present invention that the body 5 could include more than one second ring member 50.

Figure 6:
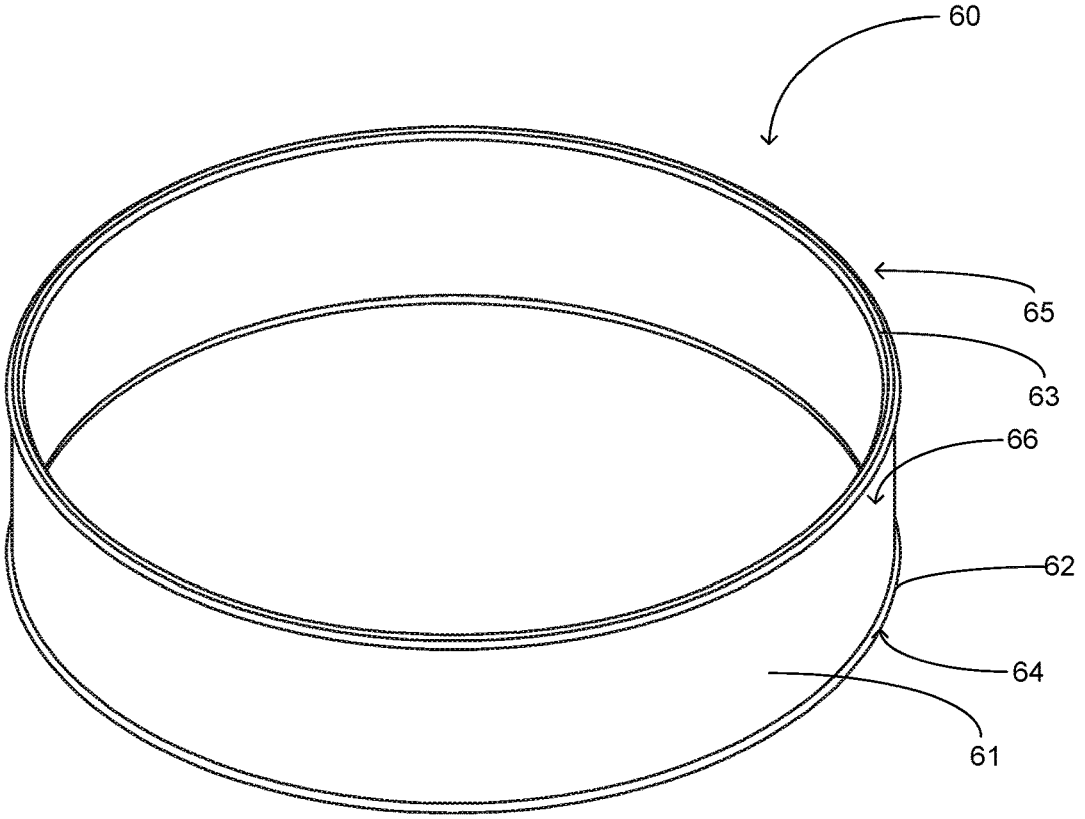
FIG. 6 is a perspective view of a first ring member of the present invention.
Figure 7:
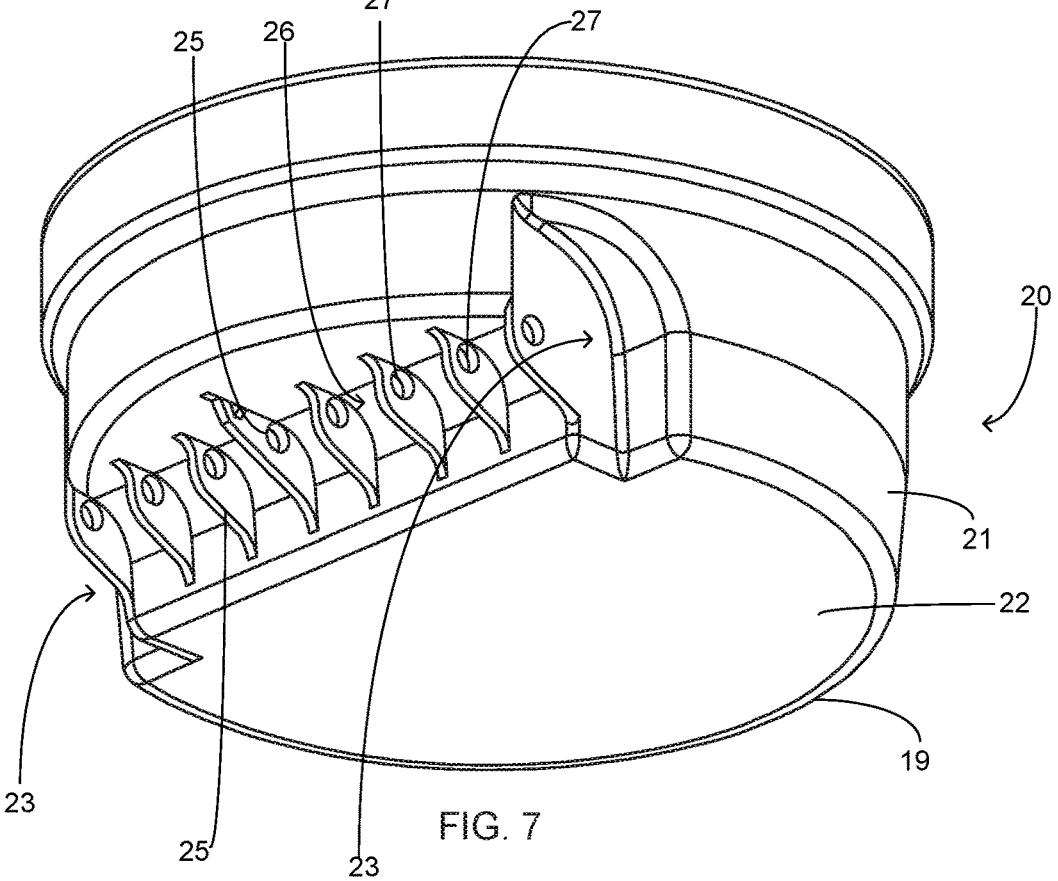
FIG. 7 is a bottom perspective view of the base assembly of the present invention.
Figure 8:
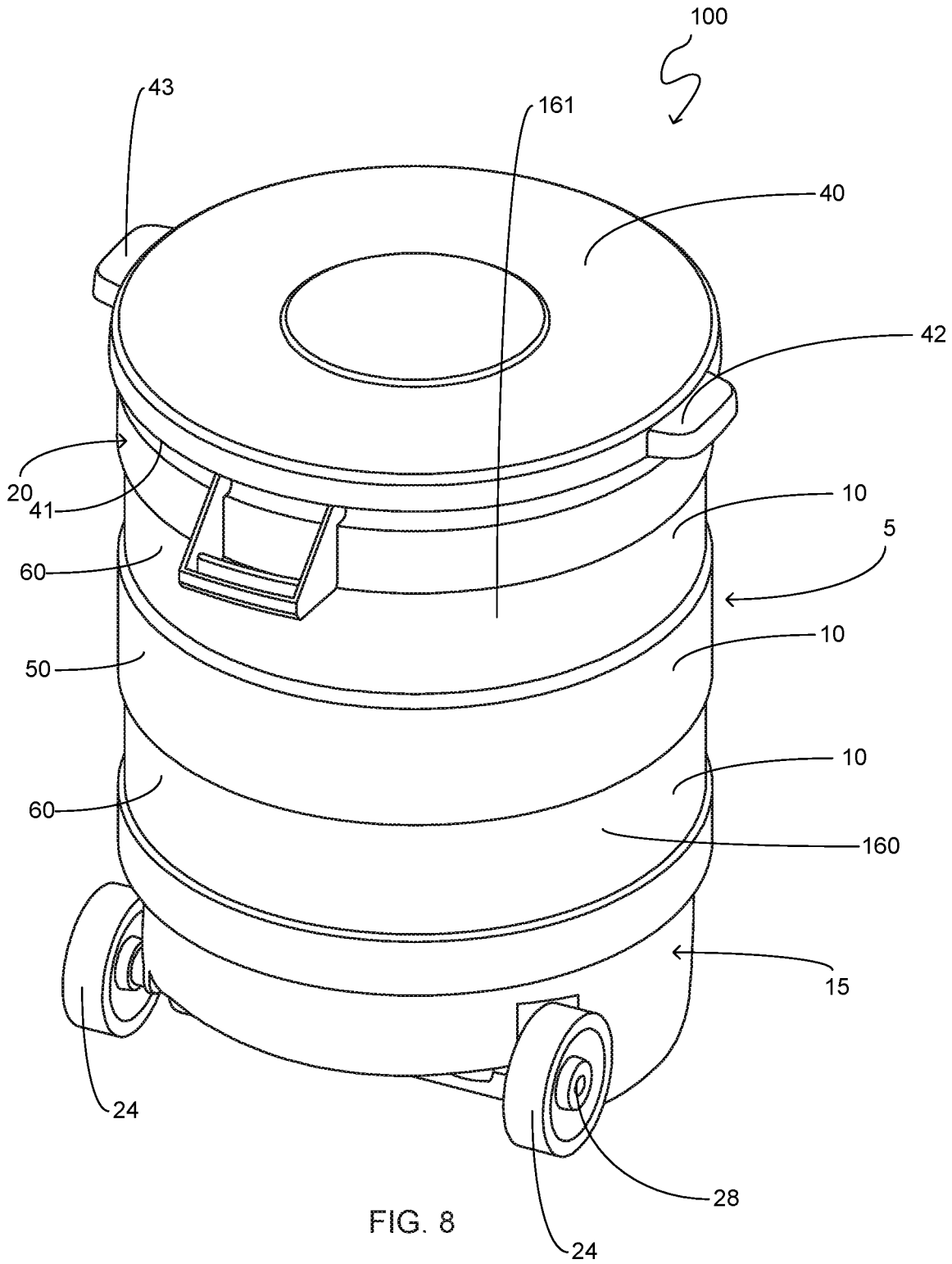
FIG. 8 is a perspective view of the present invention in its extended position.

Now referring to FIG. 6, the first ring member 60 is illustrated therein. The first ring member 60 includes wall 61 that is annular in shape. The first ring member 60 is manufactured having a diameter that is less than that of the second ring member 50. The diameter discrepancy between the first ring member 60 and the second ring member 50 is minimal so as to allow frictional engagement therebetween when moving the body 5 intermediate its first and second positions. Those skilled in the art will recognize that the diameter discrepancy between the first ring member 60 and the second ring member 50 could vary and still provide the desired functionality of maintaining frictional engagement therebetween. The first ring member 60 includes lower lip 62 and upper lip 63. Lower lip 62 and upper lip 63 are formed on the lower circumferential edge 64 and upper circumferential edge 65 respectively. The lower lip 62 and upper lip 63 extend outward from the exterior surface 66 of the wall 61. The lower lip 62 and upper lip 63 function to engage the interior surface 49 of the second ring member 50 and interior surface 3 of the wall 31 of the top assembly 30. The lower lip 62 and upper lip 63 provide engagement of the aforementioned elements with sufficient friction to maintain the body 5 in its first position. In the first position the body 5 is extended as shown herein in FIG. 8 wherein the body 5 is configured to provide a larger interior volume capacity. As shown herein in FIG. 8, the first ring member 60 above the second ring member 50 and the first ring member 60 below the second ring member 50 are exposed wherein the body 5 has been extended to its maximum height. While not illustrated herein, the second position of the body 5 comprises the first ring member 60 above the second ring member 50 and the first ring member 60 below the second ring member 50 being slidably moved to be adjacent the interior surface 3 of the top assembly and the interior surface 49 of the second ring member 50. In its second position, the ring members 40 are moved to a compressed formation wherein the body 5 is at a height that is less than that of the body 5 in its first position. It is contemplated within the scope of the present invention that the body 5 could be comprised of more than three ring members 10 as disclosed herein in order to provide a collapsible waste container 100 of alternate heights. It should be further understood within the scope of the present invention that the body 5 could be manufactured in alternate sizes wherein the diameter thereof could be provided in alternate dimensions.

The body 5 is transitioned intermediate a first position and a second position so as to alter the size of the collapsible waste container 100 either for storage or for providing alternate interior volume capacities. A user applies the required force to the top assembly 30 so as to compress the body 5. As the body 5 is compressed the lower first ring member 160 partially slides such that a portion thereof is adjacent the interior surface 49 of the second ring member 50. Additionally, the upper first ring member 161 slidably moves such that a portion thereof is adjacent the interior surface 49 of the second ring member 50.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A waste container configured to be moved intermediate a first position and a second position wherein the waste container comprises:

a base assembly, said base assembly having a wall and a bottom forming an interior volume, said wall of said base assembly being annular in shape, said wall of said base assembly being perpendicular to said bottom and extending upward therefrom, wherein said base assembly further includes opposing wheel cavities, said opposing wheel cavities configured to receive wheels therein, said base assembly further including a recess, said recess being intermediate said opposing wheel cavities, said recess further including a plurality of axle support members formed therein;

a top assembly, said top assembly having a wall, said top assembly being annular in shape, said top assembly being distal to said base assembly, said wall of said top assembly having a circumferential groove formed therein, said wall of said top assembly further including at least one handle;

two first ring members, said two first ring members having a wall being annular in shape, said wall of said two first wing members having an interior surface and an exterior surface, one of said two first ring members being adjacent said top assembly, one of said two first ring members being adjacent said bottom assembly, said two first ring members having an upper circumferential edge and a lower circumferential edge, wherein said two first ring members include an upper lip member, said upper lip member being present on the upper circumferential edge of the two first ring members, said upper lip member extending outward from the exterior surface of the wall of the two first ring members, said two first ring members further including a lower lip member, said lower lip member being present on the lower circumferential edge of the two first ring members, said lower lip member extending outward from the exterior surface of the wall of the two first ring members;

a second ring member, said second ring member being annular in shape and having a wall, said second ring member being intermediate said two first ring members, said second ring member being slidably engaged with said two first ring members, said second ring member having a diameter that is greater than that of the two first ring members; and in the first position, the two first ring members and the second ring member are slidably extended so as to provide a maximum height of the waste container.

2. The waste container as recited in claim 1, wherein said top assembly further includes a circumferential groove formed in the exterior surface of the wall of the top assembly, said circumferential groove configured to releasably secure a portion of a lid therein.

3. The waste container as recited in claim 2, wherein said wall of said second ring member further includes a lower cavity and an upper cavity, said wall of said second ring member further including a partition intermediate said upper cavity and said lower cavity.

4. A waste container configured to be moved intermediate a first position and a second position so as to provide alternate interior volume capacities wherein the waste container comprises:

a base assembly, said base assembly having a wall and a bottom forming an interior volume, said wall of said base assembly being annular in shape, said wall of said base assembly being perpendicular to said bottom and extending upward therefrom, said base assembly further including opposing wheel cavities, said base assembly further including a recess, said recess being intermediate the opposing wheel cavities;

a top assembly, said top assembly having a wall, said wall of said top assembly having an interior surface and an exterior surface, said top assembly being annular in shape, said top assembly being distal to said base assembly, said wall of said top assembly having a circumferential groove formed therein in the exterior surface of the wall, said wall of said top assembly further including at least one handle;

two first ring members, said two first ring members having a wall being annular in shape, said wall of said two first wing members having an interior surface and an exterior surface, one of said two first ring members being adjacent said top assembly, one of said two first ring members being adjacent said bottom assembly, said two first ring members having an upper circumferential edge and a lower circumferential edge;

a second ring member, said second ring member being annular in shape and having a wall, said second ring member being intermediate said two first ring members, said second ring member being slidably engaged with said two first ring members, said second ring member having a diameter that is greater than that of the two first ring members; and in the first position, the two first ring members and the second ring member are slidably extended so as to provide a maximum height of the waste container.

5. The waste container as recited in claim 4, wherein in said second position the waste container is moved to a height that is lower than that of the first position and wherein the two first ring members are slidably transitioned so as to be at least partially adjacent the second ring member.

6. The waste container as recited in claim 5, wherein the second ring member has an upper cavity and a lower cavity, said upper cavity and said lower cavity extending the length of said second ring member and wherein a partition is intermediate the upper cavity and lower cavity.

7. The waste container as recited in claim 6, wherein said two first ring members include a lower lip member, said lower lip member being present on the lower circumferential edge of the two first ring members, said lower lip member extending outward from the exterior surface of the wall of the two first ring members.

8. The waste container as recited in claim 7, wherein said two first ring members include an upper lip member, said upper lip member being present on the upper circumferential edge of the two first ring members, said upper lip member extending outward from the exterior surface of the wall of the two first ring members.

9. The waste container as recited in claim 8, wherein said base member further includes a plurality of axle support members, said axle support members being present in said recess, said axle support members extending intermediate the opposing wheel cavities, said axle support members having voids therebetween.

* * * * *